US005372022A

United States Patent [19]

Terada et al.

[11] Patent Number: 5,372,022

[45] Date of Patent: Dec. 13, 1994

[54] LOCK ASSEMBLY

[75] Inventors: Yasuharu Terada, Uozu; Yoshiyuki Horita, Toyama; Hiroshi Yoshida, Kurobe, all of Japan

[73] Assignee: Yoshida Kogyo K.K., Tokyo, Japan

[21] Appl. No.: 972,101

[22] Filed: Nov. 5, 1992

Related U.S. Application Data

[63] Continuation of Ser. No. 796,654, Nov. 25, 1991, abandoned.

[30] Foreign Application Priority Data

Nov. 26, 1990 [JP] Japan ..... 2-323827

[51] Int. Cl.[5] ..... A45C 13/10; E05B 65/52

[52] U.S. Cl. ..... 70/71; 70/75

[58] Field of Search ..... 70/69–76, 70/452

[56] References Cited

U.S. PATENT DOCUMENTS

| | | | |
|---|---|---|---|
| 2,124,736 | 7/1938 | Jacobi | 70/74 |
| 2,516,550 | 7/1950 | Cheney | 70/70 X |
| 2,730,390 | 1/1956 | Atkinson | 70/69 X |
| 3,206,953 | 9/1965 | Atkinson | 70/70 |
| 3,242,705 | 3/1966 | Chance | 70/71 |
| 3,350,902 | 11/1967 | Chance | 70/74 |
| 3,390,556 | 7/1968 | Constable | 70/75 |
| 3,392,556 | 7/1968 | Atkinson | 70/71 |
| 3,440,844 | 4/1969 | Constable | 70/70 |
| 3,464,240 | 9/1969 | Brody et al. | 70/71 |
| 3,527,067 | 9/1970 | Atkinson . | |
| 3,965,710 | 6/1976 | McCurdy | 70/452 |

FOREIGN PATENT DOCUMENTS

| | | |
|---|---|---|
| 2352815 | 4/1975 | Germany . |
| 34-5398 | 4/1959 | Japan . |
| 47-27038 | 8/1972 | Japan . |
| 52-70694 | 5/1977 | Japan . |
| 53-37993 | 9/1978 | Japan . |
| 60-226982 | 11/1985 | Japan . |

*Primary Examiner*—Peter M. Cuomo
*Assistant Examiner*—Suzanne L. Dino
*Attorney, Agent, or Firm*—Hill, Steadman & Simpson

[57] ABSTRACT

A lock assembly for use on luggage, bags and the like has a mounting plate accommodating various lock operating parts including a latch, a hook member including a hook element and an ornamental cover fitted over the mounting plate. The latch is engageable resiliently with the hook element and lockable by a key. The ornamental cover is removably connected to the mounting plate and changeable from one to another with different types and designs.

9 Claims, 8 Drawing Sheets

LOCK ASSEMBLY

This is a continuation of application Ser. No. 07/796,654, filed Nov. 25, 1991 now abandoned.

BACKGROUND OF THE INVENTION

1. Field of the Invention

This invention relates to a lock assembly for use on luggage, bags, suitcases and the like.

2. Prior Art

There are known numerous lock devices of this character which have various component parts built in a lock housing. Japanese Utility Model Publication No. 34-5398 discloses a lock comprising a housing accommodating therein a locking member with a latch and a sliding member, the locking member being held in place by a helical spring, a cover fitted over the housing and a finger provided on the cover and slidably engaged with the sliding member. The lock member and the sliding member may be put in place relatively easily by pushing them into the housing, but the use of such helical spring makes the assembly of the lock somewhat tedious and time-consuming.

Another prior art lock is disclosed in Japanese Utility Model Publication No. 53-37993 which is similar to the above described prior device in that a lock member and a latch are biased in place within a housing by a helical spring. This lock further includes a guide box mounted on the housing and a knob attached to the guide box. Its various lock components are not fit for assembly by automation.

Since both of the above prior art lock devices consist of a box-like housing in which lock component parts are preset, it is often necessary to change the designs or ornaments of the housing to be compatible with an article such as a bag to which the lock is secured, involving relatively costly small lot production coupled with the fact that most of the prior locks are fabricated by press and hence have limited ornamental sophistication.

SUMMARY OF THE INVENTION

With the foregoing drawbacks of the prior art, the present invention seeks to provide a lock assembly which is suitable for small lot production of various kinds of locks with a relatively low cost and which can be assembled with utmost ease.

The invention further provides a locking assembly constructed such that its ornamental cover is replaceable from one to another to be compatible with any particular design characteristics of an article on which the lock assembly is used.

According to the invention, there is provided a lock assembly comprising a lock body including a mounting plate having a latch and a cover fitted over the mounting plate, a hook member including a hook element releasably engageable with the latch, a manipulating knob adapted to release the hook element from the latch and a key adapted to lock and unlock the lock body, the cover being a separate ornamental member removably connected to the mounting plate.

The above and other features and advantages of the invention will be apparent from the following detailed description taken in connection with the accompanying drawings. Like reference numerals refer to like or corresponding parts throughout the several figures.

DETAILED DESCRIPTION OF THE INVENTION

Figure 1:
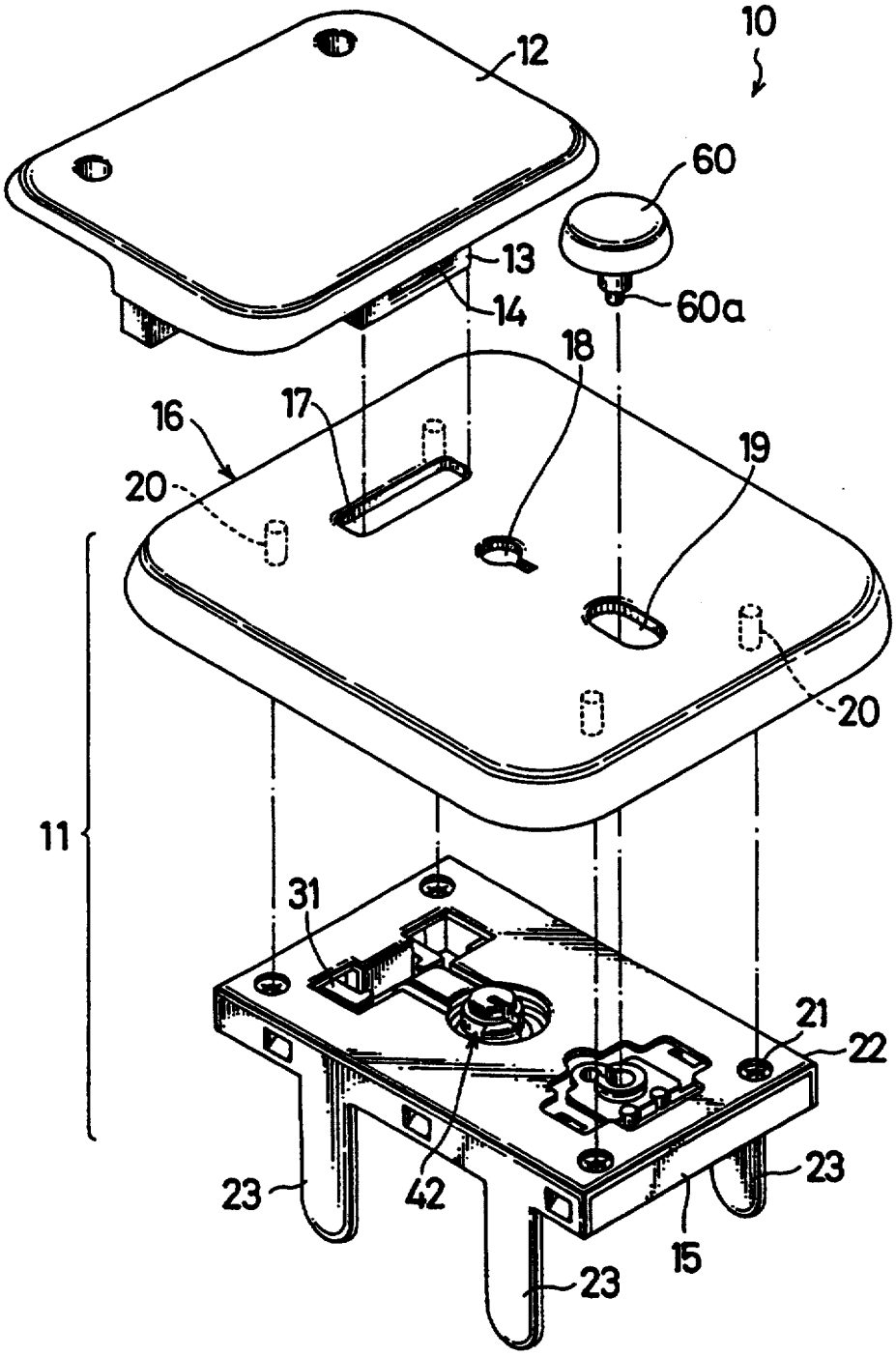
FIG. 1 is an exploded perspective view of a lock assembly according to one embodiment of the invention.
Figure 2:
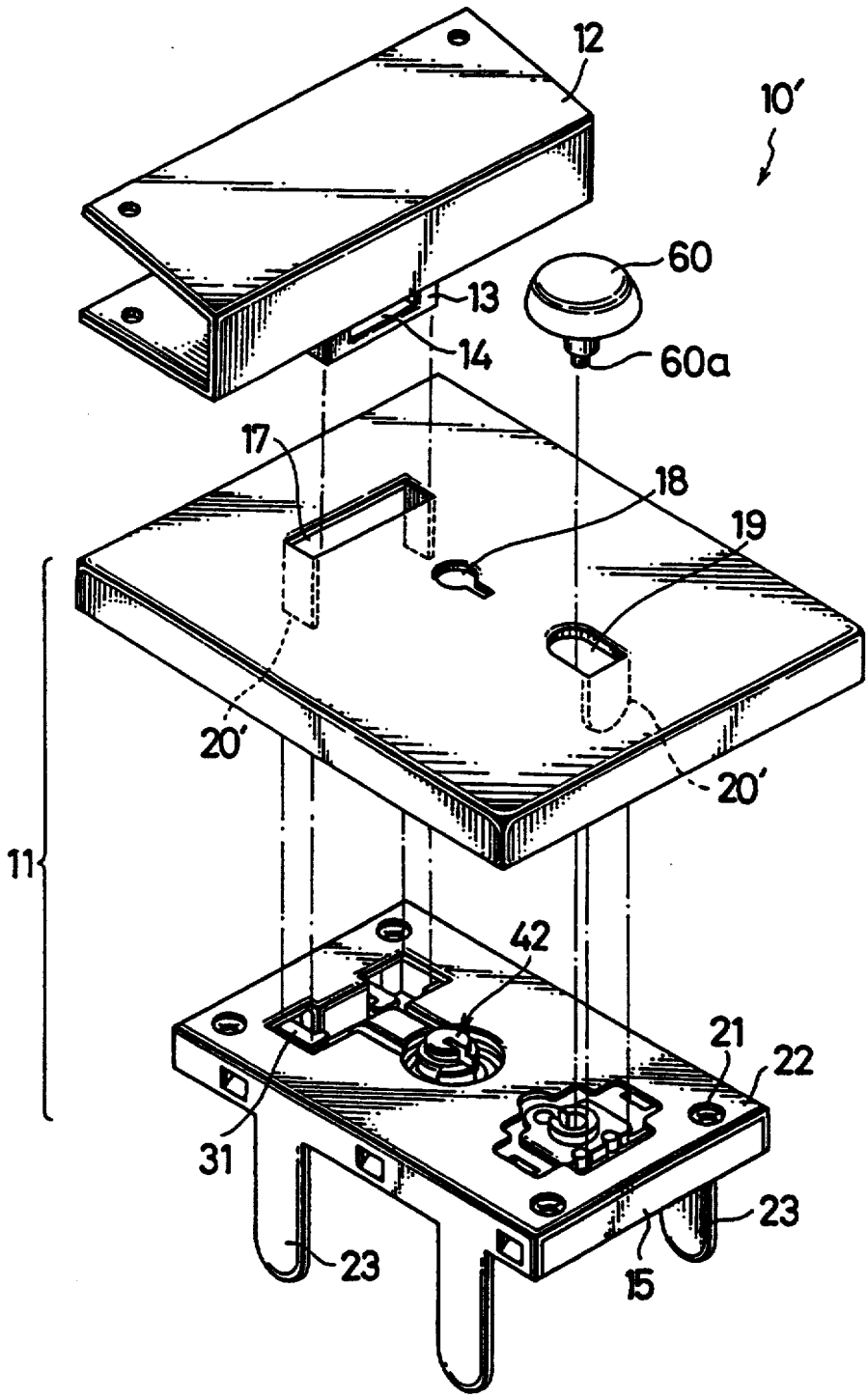
FIG. 2 is a view similar to FIG. 1 but showing another embodiment of the invention.

Referring now to the drawings and FIGS. 1 and 2 in particular, there is shown a preferred form of lock assembly 10, (10') embodying the invention. The lock assembly 10 shown in FIG. 1 is fabricated by die casting and the lock assembly 10' in FIG. 2 by press, both being substantially identical in most structural details and hence identified for their common component parts by the same reference numerals. The lock assembly 10, (10') is attached to, for example, a bag or the like (not shown) for locking and unlocking the latter in a manner well known in the art.

The lock assembly 10, (10') comprises a lock body 11 to be secured to the bag body and a hook member 12 to be secured to a cover flapper of the bag.

The hook member 12 includes a hook element 13 having a latch engaging aperture 14 for receiving a latch 32 in the lock body 11 later described.

The lock body 11 includes a mounting plate 15 for accommodating various lock operating members and an ornamental cover 16 having an elongate slot 17 for receiving the hook element 13 of the hook member 12, a key hole 18 for a key 52 (FIGS. 14 and 15) and an oblong aperture 19 for receiving a manipulating knob 60. The cover 16 is provided with a plurality of downwardly projecting pins 20 (FIG. 1) or tongues 20' (FIG. 2) engageable in corresponding engaging bores 21 formed in the mounting plate 15 to join the cover 16 and the plate 15 together. The tongues 20' are punched out to extend downwardly for clamping in the opening 28 and the third cavity 26 of the mounting plate 15.

The mounting plate 15, after having the various lock operating parts mounted therein, is covered by a casing 22 (FIG. 3) which has a plurality of fastening tabs 23 extending downwardly therefrom for securing the lock body 11 to the bag.

As better shown, the mounting plate 15 is provided with a first cavity section 24 for accommodating a group of parts engageable with the hook element 13, a second cavity section 25 for accommodating a group of parts operatively associated with the key 52 and a third cavity section 26 for accommodating a group of parts operatively associated with the knob 60 and with a sliding member 27 later described. All of these component parts are expeditiously mounted in place within the respective cavities 24, 25 and 26 in a manner analogous to block building.

The first cavity section 24 has a rectangular through-opening 28 bordering at one transverse edge thereof with the second cavity section 25 and at the opposite edge with a support lug 28' defining jointly with an inner transverse side wall 29 of the mounting plate 15 a transverse guide groove 30 for receiving a spring member 31 adapted to resiliently push the hook element 13 upwardly out of engagement with the latch 32 to separate the hook member 12 from the lock body 11.

Figure 3:
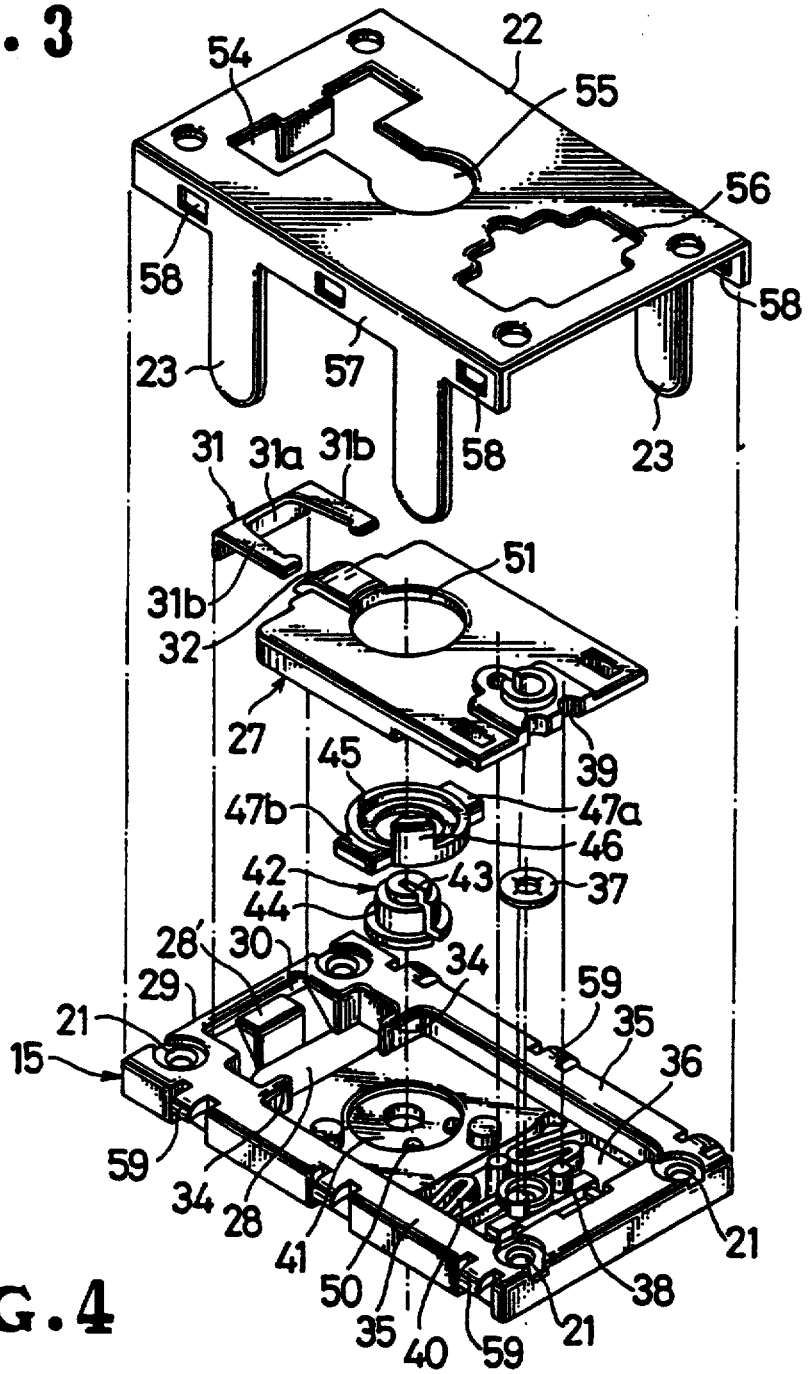
FIG. 3 is a fully exploded perspective view of a lock mechanism of the lock assembly of the invention.
Figure 4:
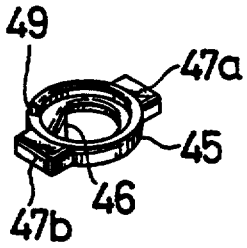
FIG. 4 is a perspective view of a ring member of the lock assembly.
Figure 5:
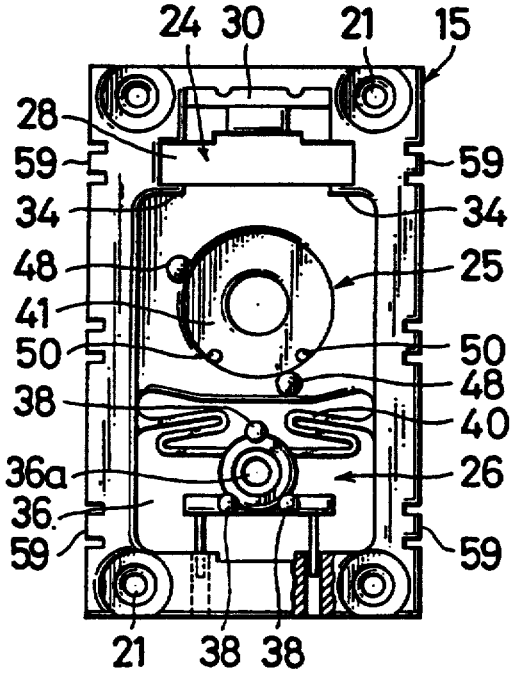
FIG. 5 is a front plan view of a base plate of the lock assembly.
Figure 6:
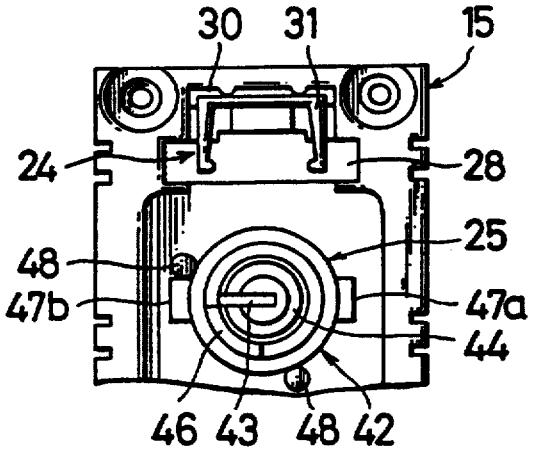
FIG. 6 is a fragmentary plan view of the base plate having a lock member and a spring member mounted therein.
Figure 7:
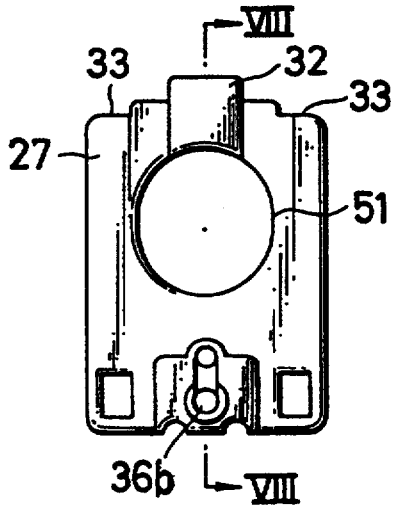
FIG. 7 is a plan view of a sliding member of the locking assembly.
Figure 8:
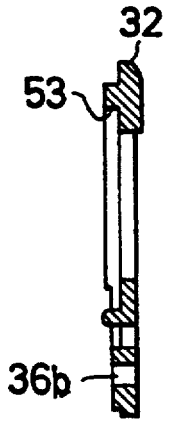
FIG. 8 is a cross-sectional view taken on the line VIII—VIII of FIG. 7.

The spring member 31, as better shown in FIG. 3, has a transverse shoulder portion **31*a* adapted to movably engage in the guide groove 30 of the mounting plate 15 and a pair of spaced longitudinal arms 31*b* extending from opposite ends of the shoulder portion 31*a* and disposed above the through-opening 28 in the first cavity section 24**.

Figure 10:
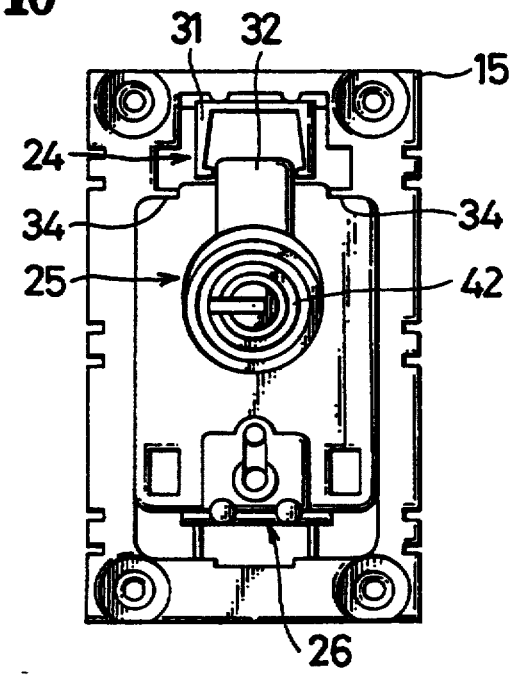
FIG. 10 is a plan view of the base plate having mounted therein the spring member, the sliding member and the lock member.
Figure 11:
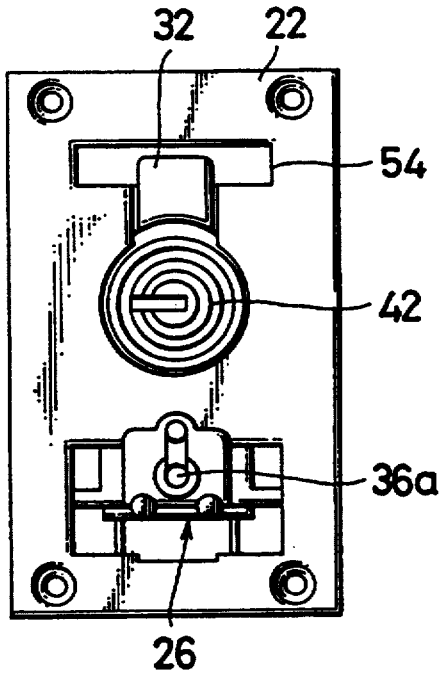
FIG. 11 is a plan view of a casing fitted over the base plate shown in FIG. 10.
Figure 12:
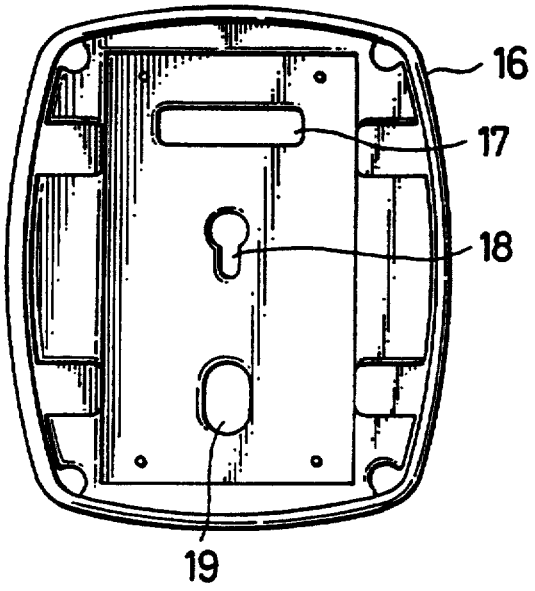
FIG. 12 is a back plan view of an ornamental cover forming a part of the lock assembly.
Figure 13:
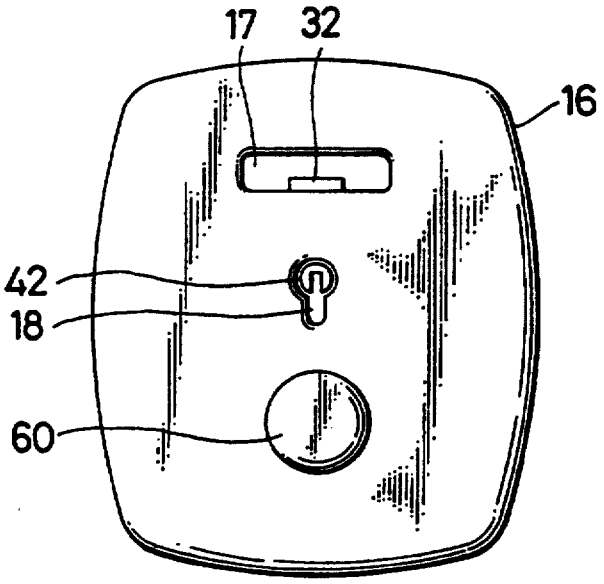
FIG. 13 is a front plan view of the lock assembly body of the invention.

The second cavity section 25 and the third cavity section 26 are contiguous to each other to provide sufficient space for movably supporting the sliding member 27 which as better shown in FIG. 3, has a latch 32 centrally projecting between recessed shoulders 33 and adapted to engage in the latch engaging aperture 14 formed in the hook element 13. The latch 32 is brought into locking engagement with the aperture 14, as shown in FIG. 10, when the sliding member 27 has moved relative to the mounting plate 15 until the shoulders 33 of the sliding member 27 come into abutting engagement with a pair of projections 34 extending inwardly from opposite longitudinal walls 35 of the mounting plate 15.

In the third cavity section 26, there is provided a support plate member 36 disposed movable longitudinally horizontally relative to the mounting plate 15.

The support plate member 36 includes an opening **36*a* for receiving a connecting pin 60*a* of the knob 60 through a push-nut 37 and a plurality of support pins 38 for connection with the sliding member 27 through respective pin receiving apertures 39. A meandering form of tension spring 40 is mounted on the support plate member 36 so as to normally bias the latter forwardly toward the first cavity section 24 in a direction in which the latch 32 of the sliding member 27 is brought into locking engagement with the aperture 14 of the hook member 12. Manipulating the knob 60 against the tension of the spring 40 releases the latch 32 from the aperture 14. Releasing the knob 60 in turn causes the spring 40 to bounce the sliding member 27 back toward the hook member 12. The tension spring 40 may be conveniently molded together with the mounting plate 15** through the medium of a plastics insert.

Designated at 41 is a generally circular recess formed in the second cavity section 25 of the mounting plate 15 for rotatably receiving a lock hub 42 having a key groove 43 and a peripheral flange 44. The lock hub 42 is rotatably mounted in a ring member 45 having an upwardly projecting lug 46, a pair of limiters **47*a*, 47*b* extending radially outwardly in diametrically opposed relation and disposed for abutting engagement with a pair of limiter pins 48 extending in spaced relation from the second cavity section 25 and a downwardly projecting pin 49 engageable in pin-receiving holes 50 formed in the circular recess 41 in the second cavity section 25**.

An oblong aperture 51 is formed in the sliding member 27 in a position registering with the lock hub 42 for allowing the insertion of the key therethrough and free movement of the sliding member 27 relative to the lock hub 42.

Figure 9:
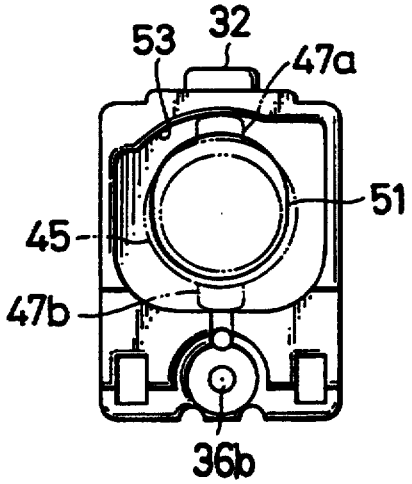
FIG. 9 is a back plan view of the sliding member.
Figure 14:
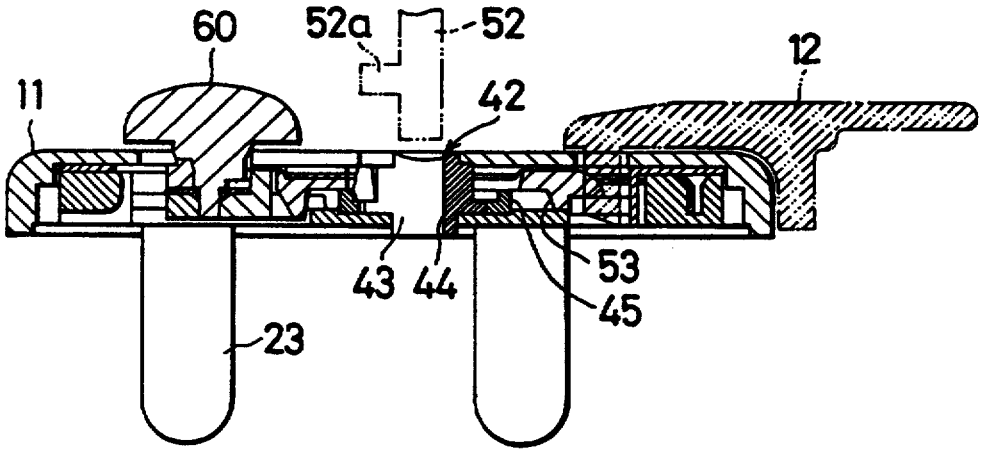
FIG. 14 is a cross-sectional view on enlarged scale of the lock assembly shown in unlocked condition.
Figure 15:
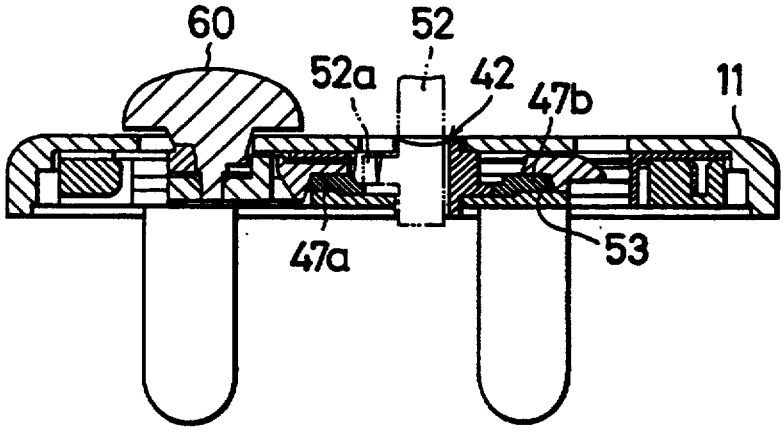
FIG. 15 is a view similar to FIG. 14 but showing the lock assembly in locked condition.

As illustrated in FIGS. 14 and 15, the key designated at 52 is inserted into the key groove 43 of the lock hub 42 with a horizontally extending prong **52*a* of the key 52 held in abutting engagement with the projecting lug 46 of the ring member 45. Rotating the key 52 thus causes the ring member 45 to rotate in one or the other direction. Rotation of the ring member 45 is limited by abutting engagement of the pair of limiter 47*a*, 47*b* with the pair of limiter pins 48 which are spaced apart by a distance such that rotative movement of the ring member 45 does not exceed an angular distance of 90° from the position in which the limiters 47*a* and 47*b* are oriented to confront the first cavity section 24 and the third cavity section 26, respectively. As shown in FIG. 9, the sliding member 27 has a cam surface 53 formed internally thereof for abutting engagement with one of the pair of limiters 47*a*, 47*b*, so as to retain the sliding member 27 stationery in abutting engagement with the projections 34 of the mounting plate 15. Rotating the ring member 45 by an angular distance of 90° releases the sliding member 27**.

In operation, the hook element 13 is inserted into the slot 17 in the cover 16, whereupon the latch 32 is retracted and then urged back into the aperture 14 of the hook element 13 by the action of the tension spring 40. Pulling the knob 60 causes the hook element 13 to spring out under the influence of tension of the spring 31.

The casing 22 has in its surface openings 54, 55 and 56 registering in position with the cavity sections 24, 25 and 26 respectively of the mounting plate 15. Lateral flanges 57 of the casing 22 are provided at spaced intervals with a plurality of engaging apertures 58 for snapping engagement with corresponding engaging lugs 59 formed in the outer longitudinal walls of the mounting plate 15. The casing 22 is thus snugly fitted over the mounting plate 15 with the lower marginal edges of the casing flanges 57 preferably flush with the lower marginal edges of the outer longitudinal wall of the mounting plate 15 as shown in FIGS. 1 and 2.

The ornamental cover 16, when fitted over the casing 22, preferably has its lower marginal peripheral edge disposed flush with the lower marginal edges of the casing 22 so that the casing 22 is protected against flexture when thrusting the fastening tabs 23 of the casing 22 into the bag.

When assembling the lock assembly 10, (10'), this is done expeditiously in a manner similar to a block building game in which the spring 31 is inserted into the groove 30 of the mounting plate 15; the lock hub 42 alone or together with the ring member 45 is placed in the recess 41 in the second cavity section 25; the sliding member 27 is fitted over the mounting plate 15; and the casing 22 is snapped into engagement with the mounting plate 15, followed by capping the ornamental cover 16 on the casing 22. Advantageously, this assembling operation can be automated since the spring members associated with the sliding member 27 are preset in the mounting plate 15.

Another yet more important advantage of the invention is that since the ornamental cover 16 is a separate item for assembly, many different types and forms can be made available from a small lot production and readily changed from one to another with versatile ornaments and designs compatible with any particular bags, suitcases, luggage and the like.

What is claimed is:

1. A lock assembly comprising:

a hook member including a hook element having a latch engaging aperture;

a lock hub assembly, said lock hub assembly having at least one radially outwardly extending limiter;

a lock body including a mounting plate and a sliding member slidably held to said mounting plate, said sliding member having a latch at one longitudinal edge thereof, a cam surface in a central portion thereof, arranged to be selectively abuttable by said limiter upon selective rotation of said lock hub assembly, and an opening at the opposite edge, said mounting plate having a first cavity section accommodating a spring member adapted to bias said hook element out of engagement with said latch, a second cavity section accommodating said lock hub assembly, and a third cavity section accommodating a support plate member movable longitudinally horizontally relative to said mounting plate and a tension spring mounted on said support plate member and adapted to normally bias said latch toward said hook element, said sliding member being movably supported within said second and third cavity sections;

a manipulating knob connected to said support plate member through said opening of the sliding member and adapted to release said hook element from said latch;

a key engageable with said lock hub assembly and adapted to lock and unlock said lock body by rotating said lock hub assembly to selectively position said limiter to abut or clear said cam surface of said sliding member respectively; and a casing overfitting said mounting plate and capturing said sliding member between said mounting plate and said casing, said casing having an opening for holding said lock hub assembly, and preventing said lock hub assembly from sliding;

a cover fitted over said mounting plate and being a separate ornamental member removably connected to said mounting plate; and wherein said lock hub assembly comprises a lock hub mounted in a ring member, said at least one limiter comprising a pair of diametrically opposed limiters extending radially from said ring member and rotatable with said ring member for an angular distance of not exceeding 90° from the position in which said limiters are oriented to confront said first cavity section and said third cavity section, respectively.

2. A lock assembly comprising:

a hook member including a hook element having a latch engaging aperture;

a lock hub assembly, said lock hub assembly having at least one radially outwardly extending limiter;

a lock body including a mounting plate and a sliding member slidably held to said mounting plate, said sliding member having a latch at one longitudinal edge thereof, a cam surface in a central portion thereof, arranged to be selectively abuttable along said cam surface by said limiter upon selective rotation of said lock hub assembly, and an opening at the opposite edge, said mounting plate having a first cavity section accommodating a spring member adapted to bias said hook element out of engagement with said latch, a second cavity section accommodating said lock hub assembly, and a third cavity section accommodating a support plate member movable longitudinally horizontally relative to said mounting plate and a tension spring mounted on said support plate member and adapted to normally bias said latch toward said hook element, said sliding member being movably supported within said second and third cavity sections;

a manipulating knob connected to said support plate member through said opening of the sliding member and adapted to release said hook element from said latch;

a key engageable with said lock hub assembly and adapted to lock and unlock said lock body by rotating said lock hub assembly to selectively position said limiter to abut or clear said cam surface of said sliding member respectively; and a casing overfitting said mounting plate and capturing said sliding member between said mounting plate and said casing, said casing having an opening for holding said lock hub assembly, and preventing said lock hub assembly from sliding; a cover fitted over said mounting plate and being a separate ornamental member removably connected to said mounting plate.

3. A lock assembly according to claim 2 wherein said casing fitted over said mounting plate is provided with additional openings registering in position with said first and third cavity sections, respectively.

4. A lock assembly comprising:

a hook member including a hook element having a latch engaging aperture;

a lock hub assembly, said lock hub assembly having at least one radially outwardly extending limiter;

a lock body including a mounting plate movably supporting a sliding member, said sliding member having a latch at one longitudinal edge thereof, a cam surface in a central portion thereof, arranged to be selectively abuttable along said cam surface by said limiter upon selective rotation of said limiter, and a sliding member opening at the opposite edge thereof, said hook element insertable into said lock body to register said aperture in longitudinal alignment with said latch;

said mounting plate holding a spring member adapted to bias said hook element out of longitudinal registry with said latch, said lock hub assembly, a support plate member movable longitudinally relative to said mounting plate and pin connected to said sliding member, and a tension spring connected between said support plate member and said mounting plate and adapted to normally bias said latch toward said hook element; and a casing overfitting said mounting plate and capturing said sliding member between said mounting plate and said casing, said casing having a lock hub opening for holding said lock hub assembly, and preventing said lock hub assembly from sliding;

a manipulating knob connected to said support plate member through said sliding member opening and adapted to longitudinally slide and release said hook element from said latch.

5. The lock assembly according to claim 4, wherein said casing provides apertures arranged for access to said latch, and said opening; and said lock body further comprising a cover mountable over said casing and having second apertures arranged in communication with said apertures of said casing.

6. A lock assembly comprising:

a hook member including a hook element having a latch engaging aperture;

a lock body including a mounting plate movably supporting a sliding member having a latch at one longitudinal edge thereof and an opening at the opposite edge thereof, said hook element insertable into said lock body to register said aperture in longitudinal alignment with said latch;

said mounting plate holding a spring member adapted to bias said hook element out of longitudinal registry with said latch, a lock hub, a support plate member movable longitudinally relative to said mounting plate and pin connected to said sliding member, and a tension spring connected between said support plate member and said mounting plate and adapted to normally bias said latch toward said hook element;

a manipulating knob connected to said support plate member through said opening of the sliding member and adapted to longitudinally slide and release said hook element from said latch; and wherein said tension spring comprises a meandering spring clip.

7. A lock assembly comprising:

a hook member including a hook element having a latch engaging aperture;

a lock body including a mounting plate movably supporting a sliding member having a latch at one longitudinal edge thereof and an opening at the opposite edge thereof, said hook element insertable into said lock body to register said aperture in longitudinal alignment with said latch;

said mounting plate holding a spring member adapted to bias said hook element out of longitudinal registry with said latch, a lock hub, a support plate member movable longitudinally relative to said mounting plate and pin connected to said sliding member, and a tension spring connected between said support plate member and said mounting plate and adapted to normally bias said latch toward said hook element;

a manipulating knob connected to said support plate member through said opening of the sliding member and adapted to longitudinally slide and release said hook element from said latch; and wherein said spring member is an L-shaped spring clip having two parallel projecting arms resiliently displaceable by said hook element during latching.

8. A lock assembly comprising:

a hook member including a hook element having a latch engaging aperture;

a lock body including a mounting plate movably supporting a sliding member having a latch at one longitudinal edge thereof and an opening at the opposite edge thereof, said hook element insertable into said lock body to register said aperture in longitudinal alignment with said latch;

said mounting plate holding a spring member adapted to bias said hook element out of longitudinal registry with said latch, a lock hub, a support plate member movable longitudinally relative to said mounting plate and pin connected to said sliding member, and a tension spring connected between said support plate member and said mounting plate and adapted to normally bias said latch toward said hook element;

a manipulating knob connected to said support plate member through said opening of the sliding member and adapted to longitudinally slide and release said hook element from said latch;

wherein said support plate provides a plurality of upstanding pins and a central aperture and said sliding member provides a plurality of pin apertures for engaging said pins for mounting said sliding member to said support plate member, and said opening of said sliding member registers with said central aperture of said support plate member; and said manipulating knob comprises an operative shaft which pierces said opening and engages into said central aperture.

9. The lock assembly according to claim 8, wherein said tension spring comprises a first S-shaped spring clip connected at one end to a lateral side of said mounting plate; and a second S-shaped spring clip connected at one end to a second lateral side of said mounting plate and at another end to said support plate member.

* * * * *